United States Patent [19]

Ramsay et al.

[11] Patent Number: 5,042,674

[45] Date of Patent: Aug. 27, 1991

[54] MOVING AND STORAGE CONTAINER

[75] Inventors: Susan J. Ramsay, Willowdale; Krzysztof D. Otoka, Toronto; Raymond Calistus, Scarborough, all of Canada

[73] Assignee: Rent A Boxx Moving Systems Inc., Toronto, Canada

[21] Appl. No.: 160,310

[22] Filed: Feb. 25, 1988

[51] Int. Cl.[5] ..... B65D 6/02

[52] U.S. Cl. ..... 220/4.24; 206/505; 206/508; 206/511; 220/4.27

[58] Field of Search ..... 220/4 E; 206/508, 509, 206/511, 512, 505

[56] References Cited

U.S. PATENT DOCUMENTS 3,145,870 8/1964 Lockwood ..... 206/508 X
4,523,692 6/1985 Lemkin ..... 220/306

FOREIGN PATENT DOCUMENTS 2170242 9/1973 France .
1408457 10/1975 United Kingdom .

*Primary Examiner*—Stephen Marcus
*Attorney, Agent, or Firm*—Brian W. Gray

[57] ABSTRACT

A container made up of a box and a lid. Three internal container volumes can electively be obtained in use. Two container volumes are obtainable by different orientations of the lid on the box. The third volume is achieved by use of a second box placed in inverted fashion on the first box, in place of the lid.

17 Claims, 8 Drawing Sheets

MOVING AND STORAGE CONTAINER

FIELD OF THE INVENTION

This invention is directed to a container for use in the moving and storage industry.

BACKGROUND TO THE INVENTION

The use of containers for the enclosure of items being moved or stored is commonplace. Containers provide convenience for organization and protection of goods during their moving and storage. Containers of a size and weight such that they can generally be carried by one or two people when loaded are widely available in a variety of sizes, shapes and material construction.

Containers commonly used for moving and storage suffer from many disadvantages. Cardboard boxes are generally weak and tend to buckle when being carried or when stacked one on top of another. They provide little protection of contents from water, fire, rodents, etc. Cardboard boxes lack resiliency and can often be used only once. Being susceptible to water damage they are difficult to clean for reuse. Cardboard containers often rely on the load bearing capability of contents to provide support for the stacking of other containers thereon.

Plastic containers in common use, while offering certain improved characteristics over cardboard boxes still suffer many disadvantages.

One severe disadvantage of commercially available containers is their lack of versatility, in use. Conventional containers generally have a fixed capacity. In order to obtain a different enclosed volume, it is generally necessary to obtain another container of different size.

The limitation of having to provide a different sized container in order to cater to different sized items or quantities thereof is highly disadvantageous. For instance, a manufacturer must manufacture, stock, and market various sizes of containers. End users also must stock different sizes. Inventory control becomes increasingly difficult with an increase in the number of different sizes of boxes which are stocked. Decisions regarding the size to be used on site must be made in advance in order to ensure availability of appropriately-sized containers for moving and storage. Automated washing of different sized boxes is more difficult than washing uniformly sized boxes. The stacking and organization of containers in storage is greatly complicated when various sizes of containers are used.

In addition, it is particularly awkward when a container is full and a little extra is left over which must be put into a new container. It would be advantageous to have a container the internal capacity of which could be expanded, if only by a small amount.

SUMMARY OF THE INVENTION

The present invention provides an improved container system having a combination of features that provide versatility heretofore unavailable.

The present invention provides in one aspect a versatile container, the enclosed volume of which can be varied to enclose, as desired by the user, one of up to three predetermined capacities.

The invention provides in another aspect a single size of container box and lid components which permit the useful enclosed volume of the container available to the user in assembled relation to be selected from a range of three values. The volume enclosed by the container lid combination is determined by the orientation of the lid on the box. The lid being dished, the useful volume depends on which face of the lid is outwardly oriented. The container volume can further be expanded to a major extent by the use of a second box in inverted relation to the first box, in place of a lid, that is, two boxes can be mated in open-end to open-end relationship to obtain a third container volume. The container in this third assembly mode achieves the largest enclosed volume.

The invention thus provides in one general aspect a box having an open-end, walls and a base with a lid. The lid is dished such that the volume enclosed by the lid and the container in a first assembled orientation differs from the volume enclosed by the lid in a second assembled orientation. The box has mating means at the open-end so that when a second box is inverted it can mate and act as a lid.

The invention further provides in yet another aspect a container that, regardless of its assembly mode can be stacked one on top of the other.

The invention further. Provides in one preferred aspect that both faces of the container lid and each box base outer face contain mating means that in assembled relation provide mating between the respective component and another component stacked thereabove or therebelow regardless of whether the components form part of the same container. Mating is achieved when transverse movement between adjacent components is substantially precluded.

In the preferred embodiment, box base face portions are provided with sets of ridges. Outer faces of the protruding ridge portions lie substantially in a plane parallel to the plane in which peripheral base face portions lie. The base face ridges are arranged such that mating can occur between an inverted box and a second box stacked on the inverted box.

The preferred embodiment also includes a lid which on one face is provided with projections in its peripheral regions, which projections abut the lower sides of a box stacked on top of the lid thereby providing a mating of the box and underlying lid. The dished second face of the lid has a countersunk central portion into which a lower portion of a box stacked thereover can fit in mating relation.

The preferred embodiment further provides that assembled container components can be secured regardless of the assembly mode of the container. In the preferred embodiment, for example, the box has holes in the rim and the lid has holes along its periphery. The respective holes of an assembled container are in aligned, unobstructed relation regardless of the assembly mode selected thus providing means for installation of securing devices through the holes for all three combinations.

The preferred embodiment further provides a container in which the box sides are provided with ribs.

The preferred embodiment further provides containers, the boxes of which nest into each other, having lids which also nest into each other.

The invention in another aspect can provide a container that, regardless of its assembly mode provides rack support members, all assembly combinations being able to be accommodated on the same suitably dimensioned two rail rack.

The invention in another aspect can provide a substantially sealed container having hole-defining portions located externally of the enclosed volume of the container.

The invention in yet another aspect can provide a box which when inverted provides a watershed.

Further, the invention can provide in one aspect in a preferred embodiment a container having peripheral rim and depending lip portions of the box that can be gripped and maneuvered from all sides.

BRIEF DESCRIPTION OF THE DRAWINGS

Certain embodiments of the invention are described, reference being made to the accompanying drawings, wherein.

DETAILED DESCRIPTION OF THE PREFERRED EMBODIMENT

Figure 1:
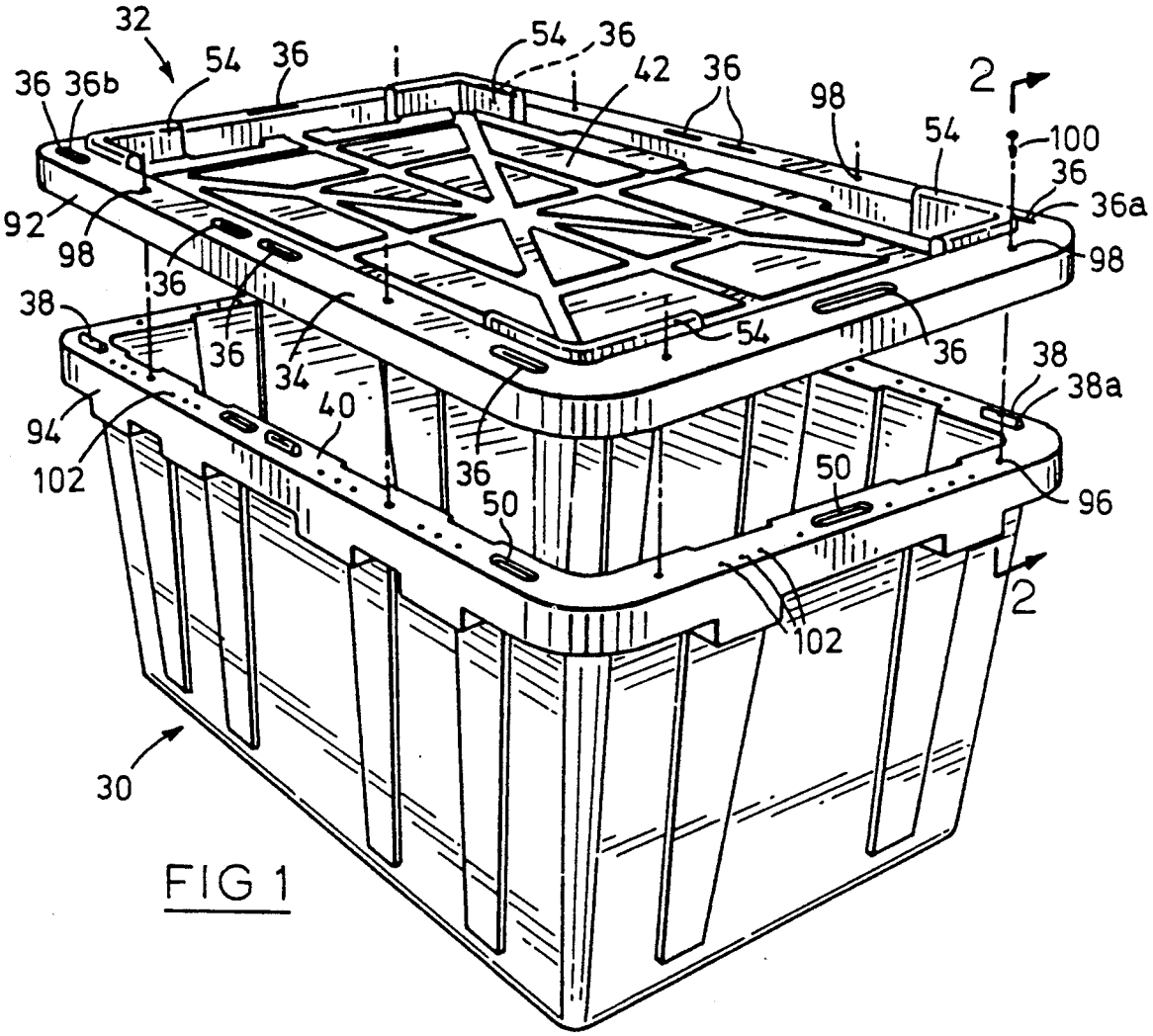
FIG. 1 is an exploded perspective view of a preferred embodiment comprising a box and lid.

Referring to FIG. 1, an exploded view of a preferred embodiment comprising a box 30 and lid 32 is illustrated. The peripheral portion 34 of lid 32 has holes 36, therethrough, into which fit lug portions 38 of box rim 40. With lid facing 42 outwardly, the five lugs 38 (all of which can best be seen in FIG. 6) can fit into one of the ten holes 36 depending on the direction of orientation of the lid 32. For example, lug 38*a* can fit into either hole 36*a* or 36*b* depending on the orientation of the lid. A sectional view of the lid with face 42 facing outwardly and lug 38 fitting through one hole 36 can be seen in FIG. 7.

Figure 4:
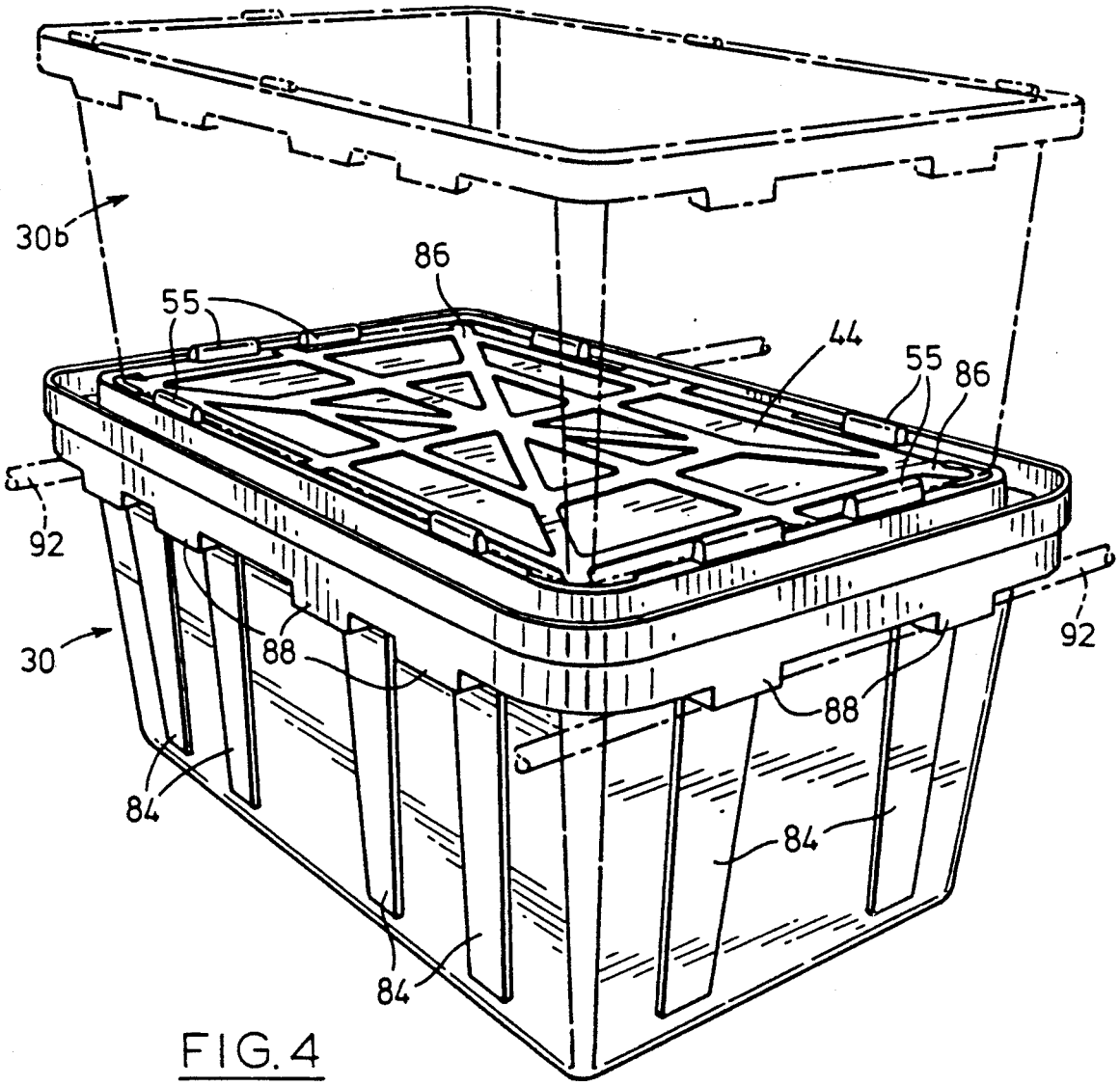
FIG. 4 is a view similar to FIG. 3, having the box lid inverted.

A second container assembly mode is obtained with lid face 42 oriented inwardly, that is, with lid face 44 facing outwardly, as illustrated in FIG. 4. In a fashion corresponding with the way the box and lid mate when lid face 42 faces outwardly, there are two horizontal orientations in which the box and lid can be assembled with lid face 44 facing outwardly. Although it cannot be seen in FIG. 4, the five lugs 38 fit into five of the ten holes 36 when the lid face 44 faces outwardly. Thus, in all instances the lid can be applied indiscriminately, in fitting closing relation with a box. A sectional view of lid 32 on box 30 with lid face 44 facing outwardly can be seen in FIG. 8. Lug 38 is visible.

Figure 7:
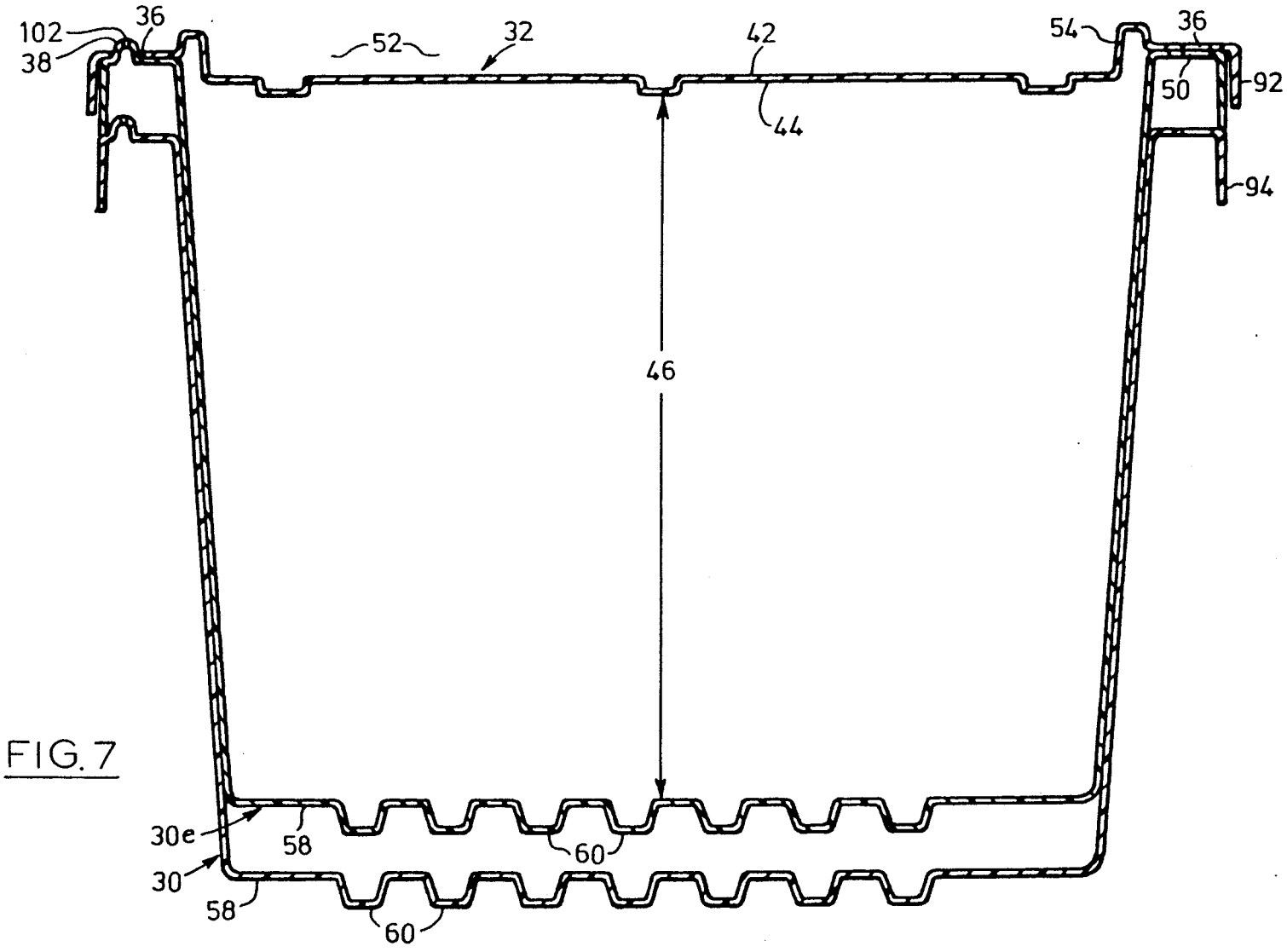
FIG. 7 is a planar sectional end elevation of two nested boxes, the upper nested box being in mating assembled relation with a lid. The view of the lower of the two boxes is taken at 7—7 of FIG. 3.
Figure 8:
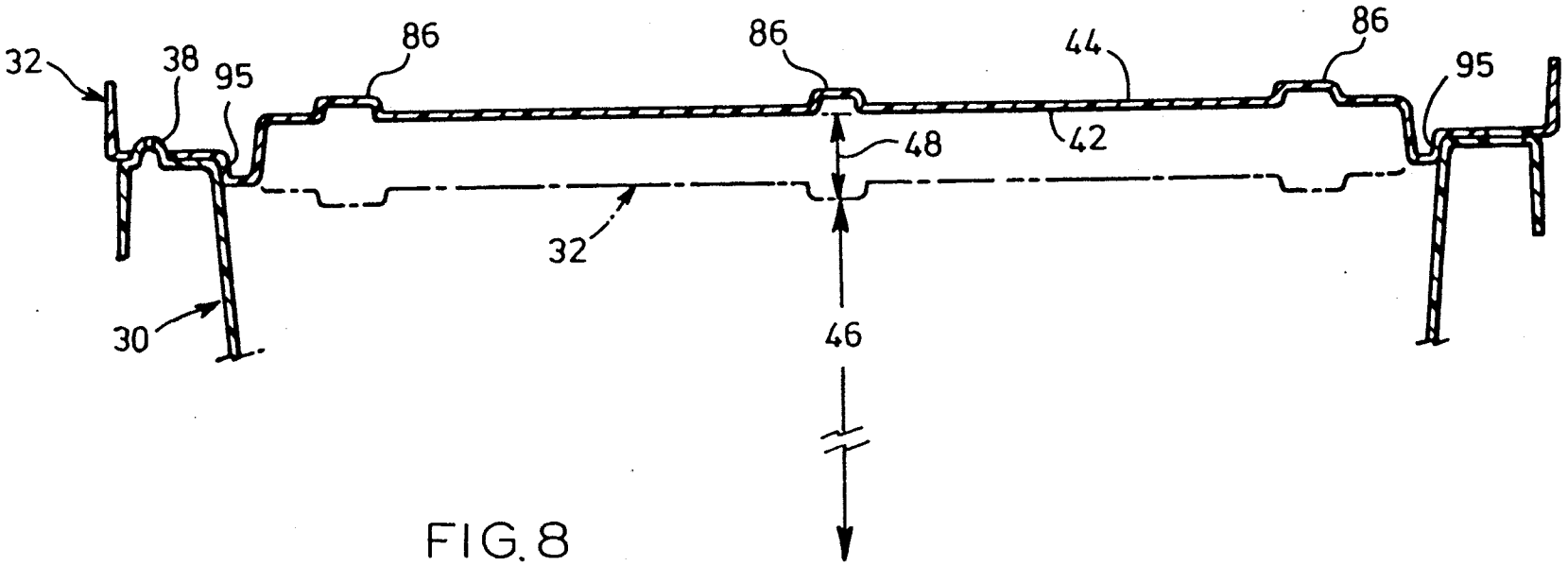
FIG. 8 is a view similar to the top portion of FIG. 7, showing the lid of FIG. 7 in phantom, and also in an inverted position.

As illustrated in FIG. 7 the enclosed volume of an assembled container is related to internal height 46 provided for example, when lid face 42 is facing outwardly. In a second assembly mode with the lid 32 inverted, the internal height 46 is increased by an internal height difference 48 which represents the extent of "dishing" of the lid 32, as indicated in FIG. 8 wherein the first assembly mode is shown partially in phantom.

Figure 6:
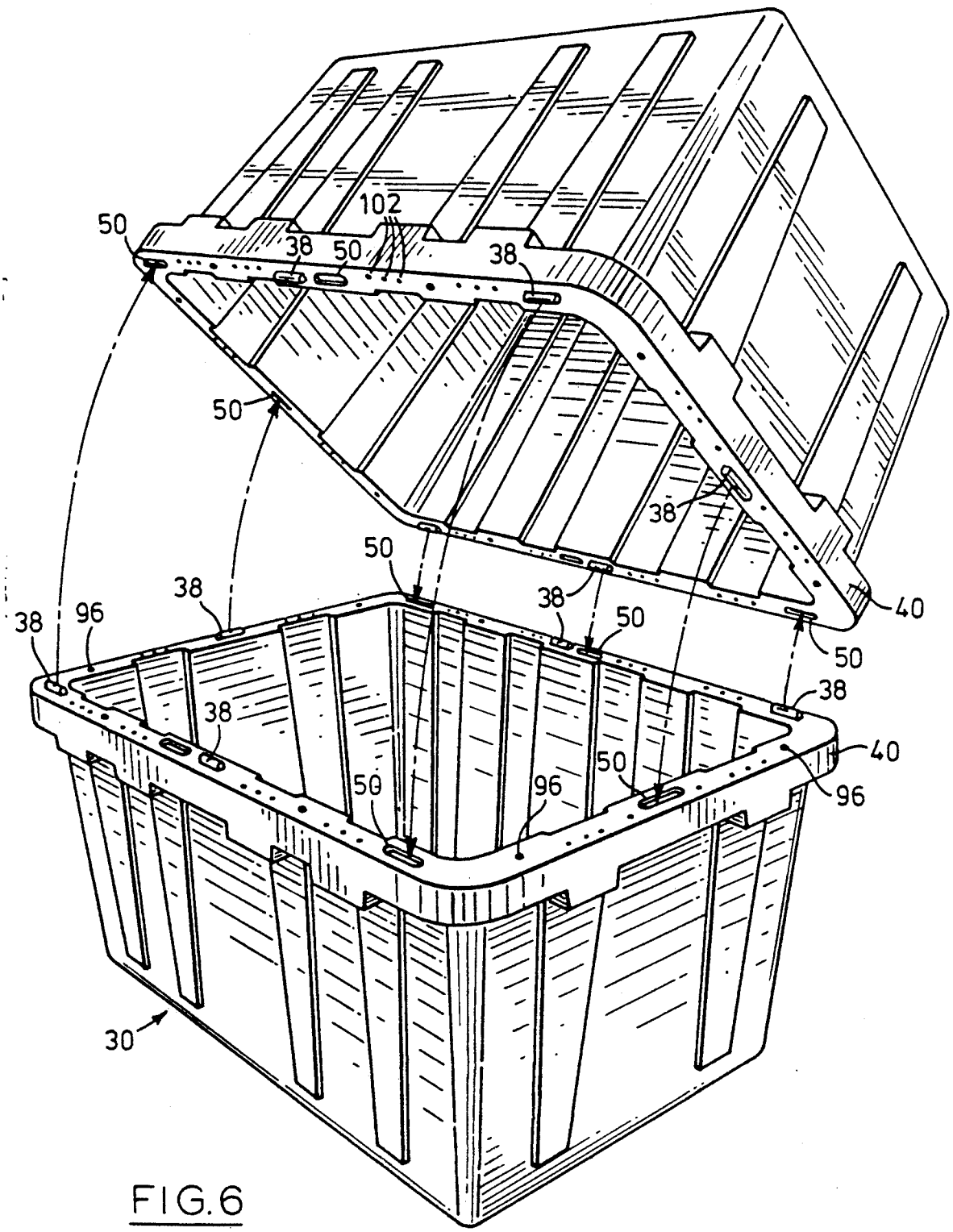
FIG. 6 is an exploded perspective view of a container comprising a lower box, beneath a mated box, in inverted canted relation thereover.
Figure 9:
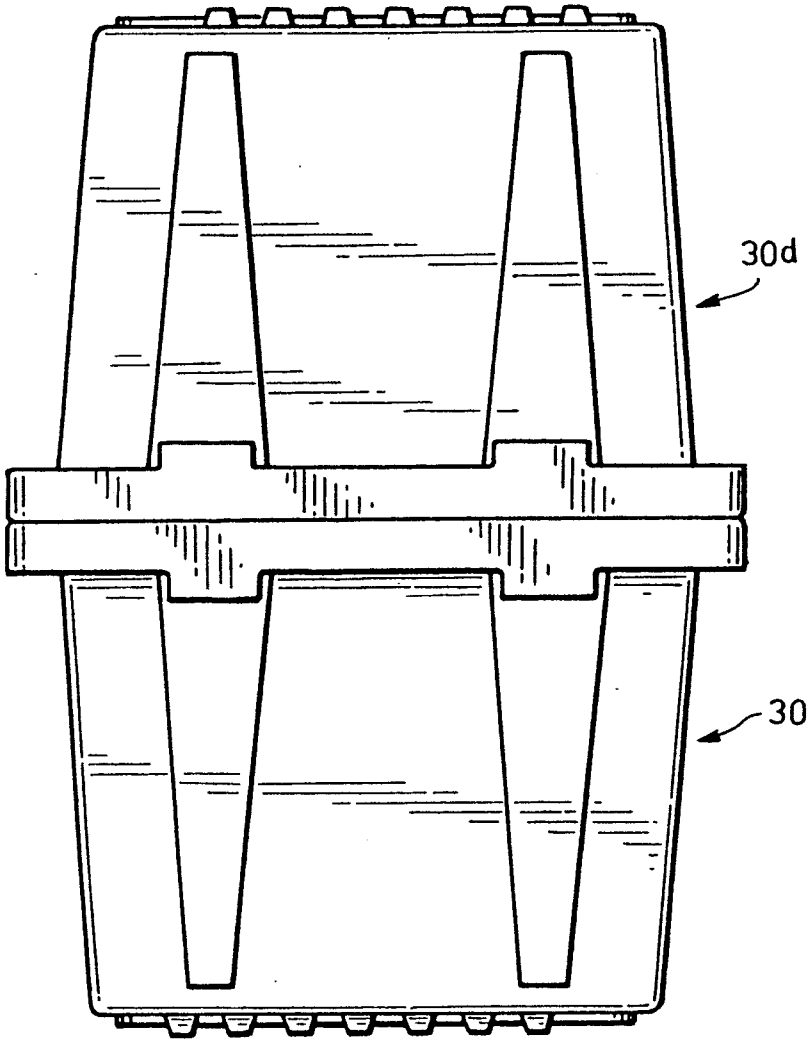
FIG. 9 is an end elevational view of a container having two box portions in assembled mated relation.

Illustrated in FIG. 6 is a third container preferred embodiment in which a third enclosed volume is obtained, by the arrangement of two boxes 30 and 30*d* as shown in FIG. 6 and also FIG. 9. Mating relation is obtained wherein respective lugs 38 fit into holes 50 of the box rims 40 of each box 30 and 30*d*.

Figure 2:
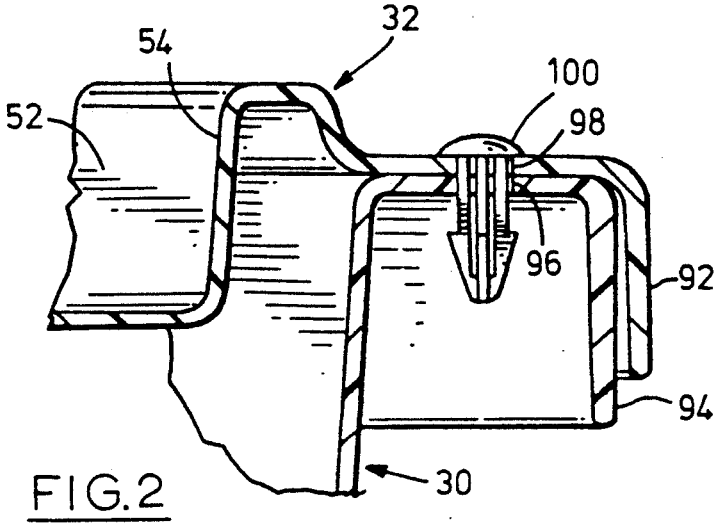
FIG. 2 is a view taken at 2—2 of FIG. 1, having the lid in assembled relation with the box.
Figure 3:
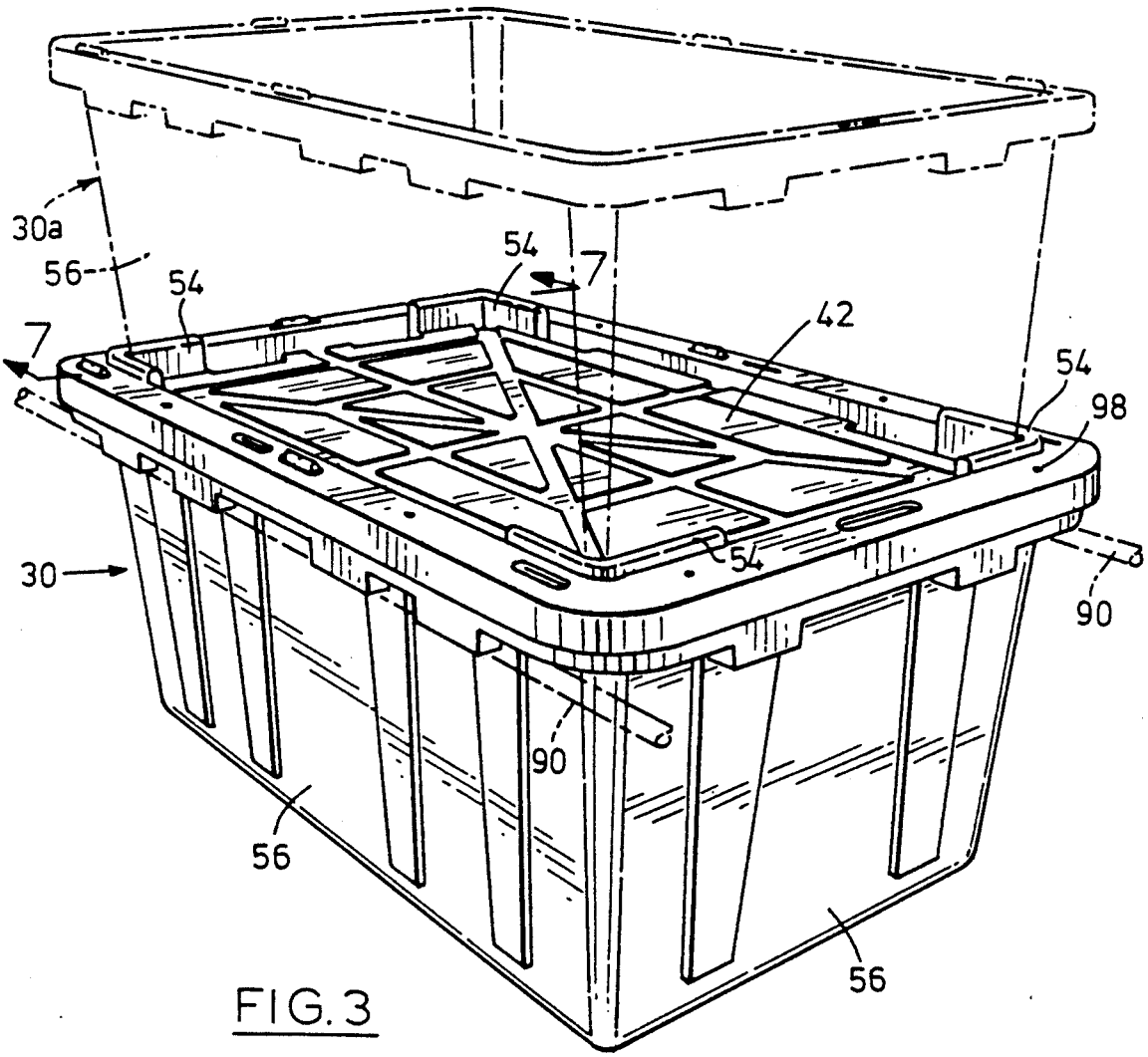
FIG. 3 is a perspective view of a preferred embodiment comprising a box and a lid, with a phantom view of a box in stacked, superposed relation thereon.

The central portion of lid face 42 defines a dished countersink 52 most easily seen in FIGS. 2 and 7. The countersunk lid portion 52 has aligning corners 54 which substantially abut in mating relation lower portions of box sides 56 of an upwardly stacked box 30*a* (in phantom) as illustrated in FIG. 3. Thus, with the lid oriented with face 42 outwardly, another box 30*a* will stack and mate on top.

Peripherally located on lid face 44 are teeth 55. When lid face 44 is oriented outwardly as shown in FIG. 4 box sides 56 of a superposed stacked box 30*b* (shown in phantom) abut the teeth 55 for mating and stacking.

Figure 5:
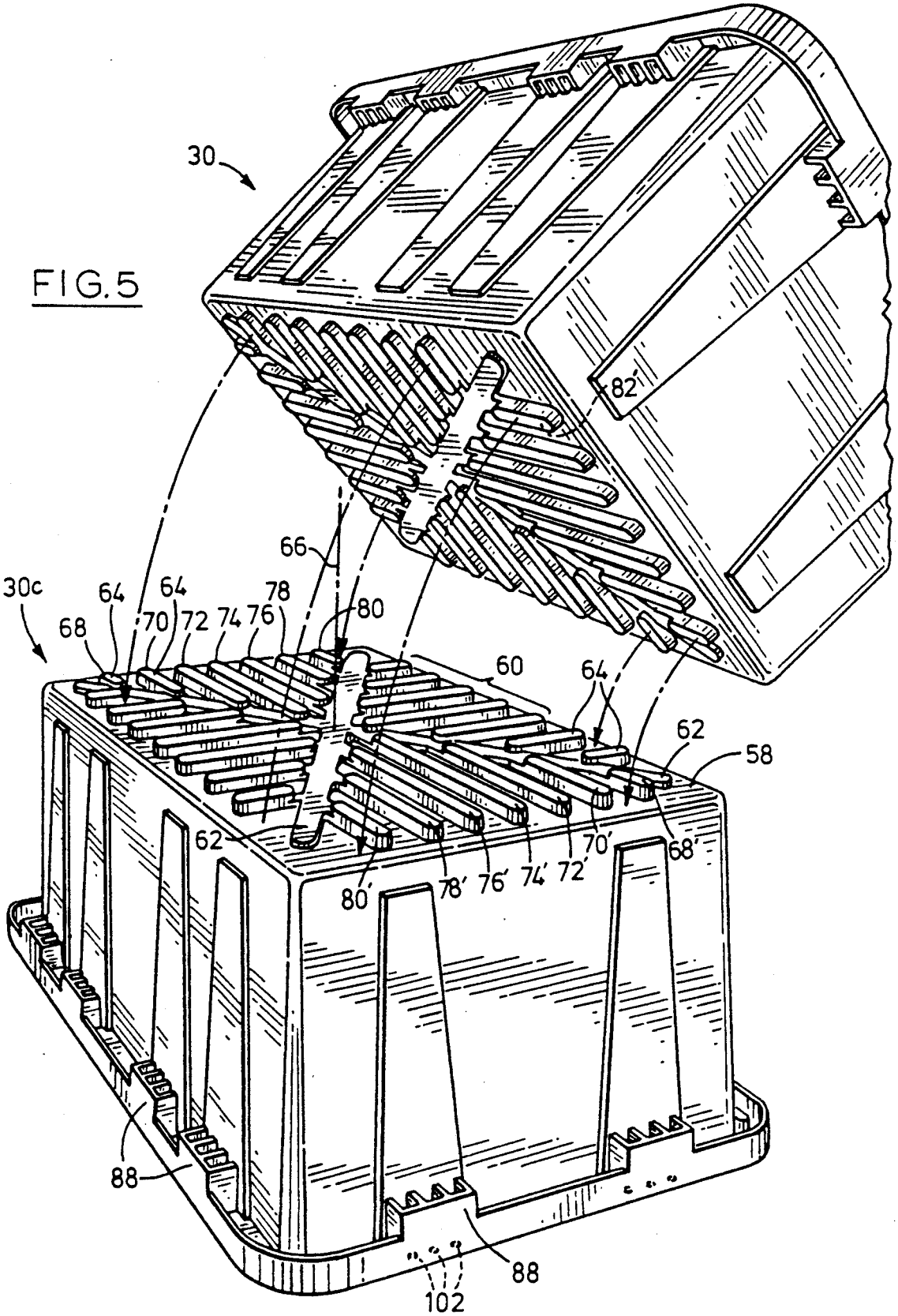
FIG. 5 is a perspective view of an inverted box with the lower portion of a superposed, canted box positioned for mating relation therewith.

Turning to FIG. 5, located on base face 58 are sets of ridges 60. The ridges are arranged such that the interaction between abutting ridge sides results in mating of boxes 30*c* and 30 in stacking relation.

Figure 10:
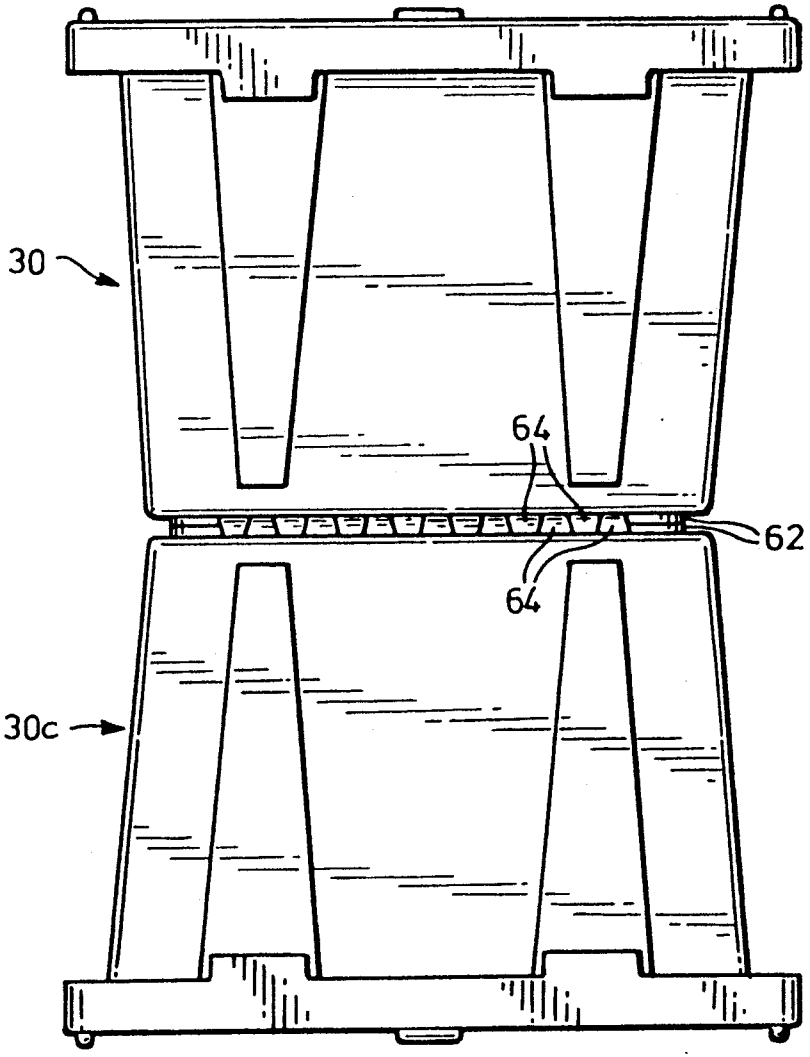
FIG. 10 is an end elevational view showing the two boxes of FIG. 5 in stacked mated relation.

Located on base face 58 are sets of ridges 60. The ridges are roughly grouped into triangular quadrants divided by crossing ribs 62 placed on the box for strength. Crossing ribs 62 are roughly one-half the height of the ridges 60. The ridges 60 are offset from each other when the boxes are mated base to base so that the bases are interlocked by abutting ridges from the box above as can be best seen in FIG. 10. Each ridge 64 extends to the base face 58 of the box against which it is stacked.

The ridge pattern is such that any triangular quadrant, when rotated 180°, about polar axis 66, is identical to the triangular quadrant opposite it. Thus ribs 68 and 68' are identical, and as well, respectively ribs 70 and 70'; 72 and 72'; 74 and 74'; 76 and 76' and 78 and 78' and 80 and 80'. The other two quadrants have a similar relationship with each other.

As mentioned opposite ridges 68 and 80', 70 and 78', 72 and 56', 74 and 74' 76 and 72', 78 and 70', and 68' and 80 are offset from each other to allow for mating. Thus, ridge sides 82 and 82', where 82' is out of view in FIG. 5, abut to align and mate boxes 30 and 30*c*.

Rotation of a given box base about polar axis 66 in FIG. 5 by 180° results in a repetition of the pattern on the base. This allows box 30 and box 30*c* to be stacked base to base in the orientation shown in FIG. 5 or in a relationship in which box 30*c* is rotated 180°. That is, in FIG. 5, second box 30 mates with box 30*c* before or after translation of box 30*c* by 180° about polar axis 66. It is contemplated that such spatial relationships can be obtained using topographical features other than ridges and including other relief features which interlock the boxes.

As shown in FIG. 4 ribs 84 are provided integral with the walls of the preferred embodiment to provide a stiffening buttressing effect.

The dished or countersunk portion 52 of lid 32 is formed with rib-like contour features 86 shown in FIG. 8 which increase lid resistance to buckling, in use.

Provided at upper portions of ribs 84 and below box rim portion 40 and contiguous to both are flange portions 88. Box 30 regardless of assembly mode can be supported on racks 90 as illustrated in FIG. 3 or racks 92 as illustrated in FIG. 4.

As shown in FIG. 7, box lid 32 includes a rim portion 92, and box 30 also includes a downturned lip portion 94. As shown in FIG. 8, box lid 32 includes an additional rim portion 95.

Referring to FIGS. 6 and 1, the box 30 is provided with holes 96 and lid 32 is provided with holes 98 which align regardless of assembly mode, when a container is assembled in mating relation, to provide means for installation of securing devices such as barbed fastener 100 shown in FIG. 2.

The preferred embodiment of box 30 is further provided with holes 102 through which can flow water when the box 30 is inverted.

The preferred embodiment of box 30 has dimensions such that box 30*e* nests into box 30 as illustrated in FIG. 7. This provides a nesting of more than 80%.

Lids of the preferred embodiment nest into each other. This is not illustrated.

We claim:

1. A container comprising:

i) a box having a base, walls and a rim defining an open end, the box shaped so as to be nestable in a second substantially identical box;

ii) a lid for the box, the lid dished such that a first volume enclosed by the container in a first assembled orientation is larger than a second volume enclosed by the container in a second assembled orientation;

iii) first mating means located on the box at the open end to permit the box to act as a lid in aligned, mated open-end-to-open-end relation with a substantially identical second box;

iv) second and third mating means located on the lid to permit the lid and box to mate in the respective assembled orientations;

v) first lid rim portions which in the first assembled orientation abut outer wall portions of an above-stacked substantially identical second box in mated stacking relation; and vi) second lid rim portions which in the second assembled orientation abut outer wall portions of an above-stacked substantially identical second box in mated stacking relation.

2. The container as claimed in claim 1 wherein the base of the box has an outer face with fourth mating means for mating the fourth mating means of a substantially identical second box.

3. A container as claimed in claim 2 in which the fourth mating means comprise raised face topography which mates with the raised face topography on the base of a second substantially identical box.

4. A container as claimed in claim 3 in which the topography has a symmetrical spatial relationship such that rotation of the box by 180° in a plane substantially parallel to that defined by the box base still permits mating with the second box.

5. A container as claimed in claim 4 in which the topography comprises raised ridge elements in triangular quadrants to that the ridge elements of the box abut against the edges of a second substantially similar box when mated base to base to mutually lock the bases from relative movement with each other in any direction.

6. A container as claimed in claim 4 in which the box has holes in the rim and the lid has holes along its periphery so placed that in the assembled container the respective holes are in aligned, unobstructed relation regardless of the assembly mode selected thus providing means for installation of securing devices through the holes.

7. A container as claimed in claim 4 in which the lid of the box nests with a substantially similar second lid.

8. A container as claimed in claim 4 in which the box has rack support members on at least two sides having shoulders to support the box on a two rail rack.

9. A container as claimed in claim 4 in which the box has peripheral rim and depending lip portions that can be gripped.

10. The container as claimed in claim 1 wherein the first lid rim portions comprise upstanding projections on a first face of the lid.

11. The container as claimed in claim 1 wherein the second lid rim portions comprise upstanding projections on a second face of the lid.

12. The box as claimed in claim 1 wherein the first mating means cooperate with the second mating means.

13. The container as claimed in claim 1 wherein the first mating means cooperate with the third mating means.

14. The container as claimed in claim 1 wherein the first mating means comprise projections and holes.

15. The container as claimed in claim 14 wherein the second and third mating means comprise holes.

16. A container comprising:

i) a box having a rim defining an open end;

ii) a lid for the box, the lid dished such that a first volume enclosed by the container in a first assembled orientation is larger than a second volume enclosed by the container in a second assembled orientation;

iii) first and second mating means located on the lid to permit the lid and box to mate in the respective assembled orientations;

iv) first lid rim portions which in the first assembled orientation abut outer wall portions of an above-stacked substantially identical second box in mated stacking relation;

v) second lid rim portions which in the second assembled orientation abut outer wall portions of an above-stacked substantially identical second box in mated stacking relation; and vi) box mating means located at the open end of the box to permit the box to act as a lid in aligned, mated open-end-to-open-end relation with a substantially identical second box.

17. The container as claimed in claim 16 wherein the box further comprises a base having outer base mating means for mating the outer base mating means of a substantially identical second box.

* * * * *